US010793813B2

(12) United States Patent
Stafford, III et al.

(10) Patent No.: US 10,793,813 B2
(45) Date of Patent: Oct. 6, 2020

(54) DISPERSIBLE PACKAGING FOR TOILET PAPER MOISTENER PRODUCT

(71) Applicant: GPCP IP Holdings LLC, Atlanta, GA (US)

(72) Inventors: Thomas I. Stafford, III, Roswell, GA (US); Sarah Anne Lemke, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 205 days.

(21) Appl. No.: 15/584,355

(22) Filed: May 2, 2017

(65) Prior Publication Data

US 2017/0321172 A1 Nov. 9, 2017

Related U.S. Application Data

(60) Provisional application No. 62/332,530, filed on May 6, 2016.

(51) Int. Cl.

| | |
|---|---|
| ***C11D 17/04*** | (2006.01) |
| ***A47K 7/00*** | (2006.01) |
| ***B65D 65/46*** | (2006.01) |
| *A47K 10/32* | (2006.01) |

(52) U.S. Cl.

CPC ..... *C11D 17/042* (2013.01); *A47K 7/00* (2013.01); *B65D 65/46* (2013.01); *A47K 2010/3273* (2013.01)

(58) Field of Classification Search

None

See application file for complete search history.

(56) References Cited

U.S. PATENT DOCUMENTS

| | | | |
|---|---|---|---|
| 2,695,704 | A | 11/1954 | McGredy |
| 3,601,252 | A | 8/1971 | Sager |
| 3,921,802 | A | 11/1975 | Thompson |
| 3,986,640 | A | 10/1976 | Redmond |
| 4,332,319 | A | 6/1982 | Hurwood |
| 4,539,793 | A | 9/1985 | Malek |
| 5,346,061 | A | 9/1994 | Newman et al. |
| 5,373,966 | A | 12/1994 | O'Reilly et al. |
| 5,814,159 | A | 9/1998 | Paley et al. |
| 5,988,371 | A | 11/1999 | Paley et al. |
| 7,992,709 | B2 | 8/2011 | West et al. |
| 8,069,985 | B2 | 12/2011 | Burattini |
| 8,225,932 | B2 | 7/2012 | Burattini |
| 2002/0169092 | A1* | 11/2002 | Alexandre Catlin ..... B65B 9/04 510/220 |

(Continued)

OTHER PUBLICATIONS

International Search Report dated Jul. 31, 2017, PCT Application No. PCT/US2017/031191, 5 pages.

(Continued)

*Primary Examiner* — Lorna M Douyon
(74) *Attorney, Agent, or Firm* — Laura L. Bozek

(57) ABSTRACT

A water dispersible pouch for moistening a tissue includes a film that encloses a cavity, the film having a body portion and a region of weakness, the region of weakness having a thickness that is less than a thickness of body portion; and a substantially waterless wetting composition disposed within the cavity; wherein the water dispersible pouch has a rupture strength at the region of weakness of less than 10 pounds per square inch (psi).

24 Claims, 6 Drawing Sheets

(56) References Cited

U.S. PATENT DOCUMENTS

2003/0077005 A1* 4/2003 Fisher ..... B65B 9/04 383/1
2005/0261155 A1* 11/2005 Wiedemann ..... C07D 17/0017 510/295
2006/0172912 A1* 8/2006 Burt ..... C11D 1/835 510/383
2007/0117734 A1* 5/2007 Jonke ..... C11D 3/3945 510/302
2007/0142810 A1 6/2007 Visscher et al.
2007/0289891 A1 12/2007 Davies
2008/0004198 A1* 1/2008 Joinson ..... C11D 17/042 510/297
2008/0027405 A1 1/2008 Hernandez et al.
2008/0264807 A1 10/2008 Caracci et al.
2008/0264828 A1 10/2008 Benson et al.
2009/0324693 A1* 12/2009 Lemke ..... A61F 13/8405 424/443
2010/0313360 A1* 12/2010 Menting ..... C11D 1/83 8/137
2011/0166056 A1* 7/2011 Huber ..... B29C 45/73 510/224
2011/0186467 A1* 8/2011 Denome ..... C11D 17/042 206/524.7
2011/0259917 A1 10/2011 West et al.
2016/0040101 A1* 2/2016 De Poortere ..... C11D 1/22 510/296
2016/0265165 A1 9/2016 Proctor, Sr.
2016/0367447 A1* 12/2016 Aubert ..... A61Q 5/10

OTHER PUBLICATIONS

Written Opinion dated Jul. 31, 2017, PCT Application No. PCT/US2017/031191, 4 pages.

* cited by examiner

DISPERSIBLE PACKAGING FOR TOILET PAPER MOISTENER PRODUCT

CROSS-REFERENCE TO RELATED APPLICATION

This application is based on U.S. Provisional Patent Application No. 62/332,530, filed May 6, 2016, which is hereby incorporated by reference in its entirety.

TECHNICAL FIELD

The present invention is directed generally to tissue products. More specifically, the present invention is related to products for moistening tissue products.

BACKGROUND OF THE INVENTION

Generally, consumers desire softness in tissue products, such as bath tissue (i.e., toilet paper), facial tissue, and napkins. However, tissue product quality may be unpredictable and poor, especially in public places. Consumers with particularly sensitive skin may not be able to use rough, coarse, and/or thin bath tissue because such tissues may be uncomfortable or cause skin irritation. Although consumers can purchase soft tissue for home use, they may not be able to avoid using rough, thin tissues in public places, such as public restrooms, when they are traveling or away from home.

A variety of products have been developed to provide consumers with a portable, convenient liquid moisturizer or cleanser to soften tissue. For example, portable travel-size pouches and sprays with tissue moisturizers/cleansers are available. However, such portable pouches are difficult to open and include materials that cannot be discarded easily (i.e., non-flushable or water dispersible). Further, spray bottles are heavy, inconvenient, and are non-flushable.

Based on the foregoing, there still exists a need for a portable, water dispersible packaging for a tissue product moistener/cleanser. Accordingly, it is to solving this and other needs the present invention is directed.

SUMMARY OF THE INVENTION

In one aspect, described herein is a water dispersible pouch which includes a film that encloses a cavity and a substantially waterless wetting composition disposed within the cavity. The film has a body portion and a region of weakness. The region of weakness has a thickness that is less than a thickness of the body portion. In addition, the water dispersible pouch has a rupture strength at the region of weakness of less than 10 pounds per square inch (psi).

According to another aspect, a water dispersible pouch includes a polyvinyl alcohol film that encloses a cavity and a substantially waterless wetting composition comprising an oil disposed within the cavity. The polyvinyl alcohol film has a body portion and a region of weakness. The region of weakness has a thickness that is less than a thickness of the body portion. In addition, the water dispersible pouch has a rupture strength at the region of weakness of less than 10 pounds per square inch (psi).

A method of making a water dispersible pouch is also described herein. In some aspects, the method includes shaping a sheet of film to form a body portion that encloses a cavity comprising a substantially waterless wetting composition. The film has a region of weakness with a thickness that is less than a thickness of the body portion, which provides the water dispersible pouch with a rupture strength at the region of weakness of less than 10 pounds per square inch (psi).

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the invention will become apparent from the following description taken in conjunction with the examples showing aspects of the present invention.

BRIEF DESCRIPTION OF THE DRAWINGS

The invention will be better understood and the above object as well as other objects other than those set forth above will become apparent when consideration is given to the following detailed description thereof. Such description makes reference to the annexed drawing wherein.

DETAILED DESCRIPTION OF THE INVENTION

Figure 1A:
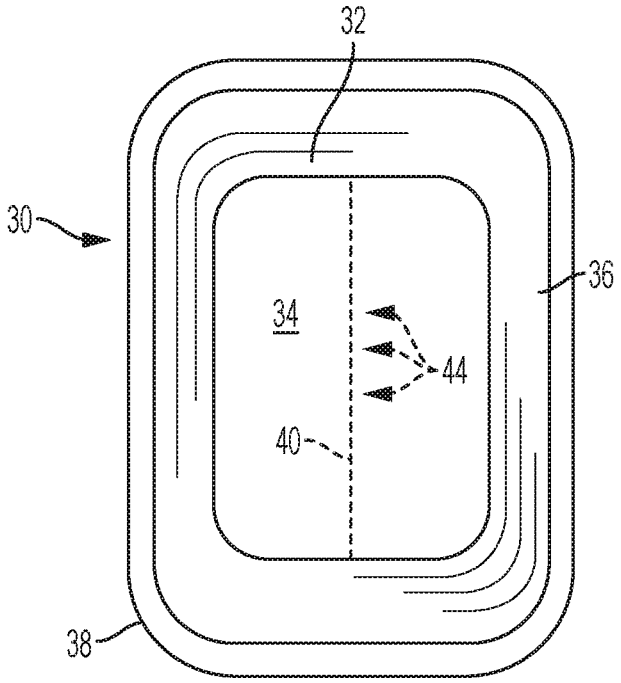
FIG. 1A is a top view of a water dispersible pouch.

Described herein is a delivery mechanism for wetting tissues, such as bath tissues, facial tissues, and napkins, in a convenient and discrete packaging. The delivery system includes a water dispersible pouch with a wetting agent that softens tissues and/or the cleaning process when added to the tissue. In other aspects, the water dispersible pouch can be used to wet/moisten any paper/tissue product, such as, without limitation, a wet wipe or non-woven substrate. The packaging is convenient because it disperses or dissolves in water and therefore can be discarded in the toilet after use. The water dispersible pouches can be inserted into a stack of tissues and ruptured using manual pressure to disperse the wetting agent, which keeps the user's hands from being contaminated. The individual pouches also provide a suitable unit dosage of the wetting agent. Compared to sprays or other lotions that are used to moisten a tissue and provide a non-reproducible amount of a wetting agent or lotion, the water dispersible pouches disclosed herein are convenient and provide a reproducible moisturizing effect to a tissue.

For a fuller understanding of the nature and desired objects of this invention, reference should be made to the above and following detailed description taken in connection with the accompanying figures. When reference is made to the figures, like reference numerals designate corresponding parts throughout the several figures.

The terms "by weight" and "% by weight," as used herein refer to weight of a given substance divided by the total weight of the tissue or wetting composition, whichever is indicated. Typically, weight is measured in grams (g).

As used herein, the term "water dispersible" means the ability of a material to readily break apart in water. In particular, the term "water dispersible" means the ability of a material to readily break apart due to the physical forces encountered during flushing in a common toilet, conveyance in a common wastewater system, and processing in a common treatment system.

As used herein, the term "water soluble" when used in reference to a film means substantially completely dissolves in water.

As used herein, the term "substantially waterless" when used in reference to the wetting composition means less than 15 weight % (wt. %) water. In one aspect, substantially waterless means less than 12 wt. % water. In another aspect, substantially waterless means less than 5 wt. % water. Yet, in another aspect, substantially waterless means less than 15, 14, 13, 12, 11, 10, 9, 8, 7, 6, 5, 4, 3, 2, or 1 wt. % water.

As used herein, the term "region of weakness" when used in reference to a film means a portion of the film having a thickness that is less than the thickness of the remaining body of the film.

As used herein, the term "rupture strength" of the water dispersible pouch refers to the amount of compressive pressure that the pouch can withstand before rupturing. The rupture strength is measured by increasing the load (compressive pressure) on the pouch at a standard rate (pressure/time) until the pouch ruptures. To perform a measurement, the pouch is placed on a platen in a pressure-load apparatus. A flat metal disc increases the compressive pressure on the top surface of the pouch at a standard rate and time until the pouch ruptures. The rupture strength may be measured in units of pounds per square inch (psi).

In one aspect, a water dispersible pouch includes a film that encloses a cavity, the film having a body portion and a region of weakness, the region of weakness having a thickness that is less than a thickness of body portion; and a substantially waterless wetting composition disposed within the cavity; wherein the water dispersible pouch has a rupture strength at the region of weakness of less than 10 pounds per square inch (psi).

In another aspect, a water dispersible pouch includes a polyvinyl alcohol film that encloses a cavity, the polyvinyl alcohol film having a body portion and a region of weakness, the region of weakness having a thickness that is less than a thickness of body portion; and a substantially waterless wetting composition including an oil disposed within the cavity; wherein the water dispersible pouch has a rupture strength at the region of weakness of less than 10 pounds per square inch (psi).

Figure 1B:
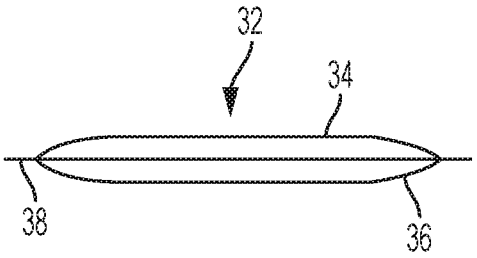
FIG. 1B is a front side view of the water dispersible pouch of FIG. 1A.
Figure 1C:
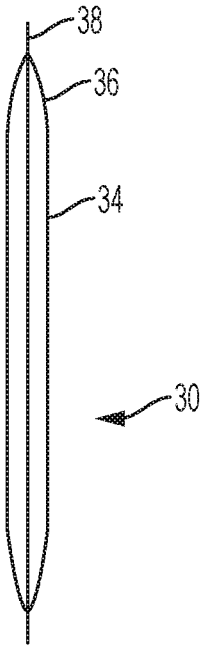
FIG. 1C is a side view of the water dispersible pouch of FIG. 1A.

Turning now to the Figures, FIGS. 1A-1C illustrate a water dispersible pouch 30 according to an aspect of the present invention. FIG. 1A is a top view of the water dispersible pouch 30. FIG. 1B is a front side view of the water dispersible pouch 30 of FIG. 1A. FIG. 1C is a side view of the water dispersible pouch 30 of FIG. 1A.

The central pouch area 32 includes a generally planar region 34 as viewed from the side. The planar shape should not be considered as limiting. Alternative shapes in region 34, such as oval, round, ribbed, and the like can be employed. The generally planar region 34 tapers down through tapering side walls 36 towards the skirt 38 that surrounds the central pouch area 32. The water dispersible pouch 30 includes a score line 40 (region of weakness) arranged in medial portion of the central pouch area 32. The scores 44 of score line 40 penetrate deeply enough into external film above central pouch area 32 such that score line 40 can be ruptured by manual application of pressure on either side thereof. Because the film encloses a substantially waterless wetting composition, the scores 44 of the score line 40 do not completely penetrate the external film.

The lateral dimensions (length and width) of the water dispersible pouch 30 can generally vary. The water dispersible pouch 30 is not limited to the size and/or shape shown in FIGS. 1A-1C. The water dispersible pouch 30 can have any shape, size, or dimensions. For example, the water dispersible pouch 30 can have a spherical shape, cubic shape, cone shape, cylindrical shape, pyramidal shape, prism shape, hemi-spherical shape, cuboid shape, or any combination of the foregoing shapes.

In some aspects, the water dispersible pouch 30 has lateral dimensions that are generally commensurate with the current sizes of sheets of bath tissue. In one aspect, lateral dimensions of water dispersible pouch 30 (length and width) are roughly equivalent and are each in a range from about 2 inches to about 6 inches. In another aspect, the length and width of the water dispersible pouch 30 are each in a range from about 2.5 inches to about 5 inches. Yet in another aspect, the length and width of the water dispersible pouch 30 are each in a range from about 3 to about 4 inches. Still yet, in another aspect, the length and width of the water dispersible pouch 30 are each about or in any range from about 1, 2, 3, 4, 5, and 6 inches. In another aspect, the water dispersible pouch 30 is elongated and has dimensions ranging from about 4 by 6 inches to about 2.5 to 4 inches. In one aspect, the length and/or width of the water dispersible pouch 30 is about or in any range from about 1, 2, 3, 4, 5, and 6 inches.

The thickness of the water dispersible pouch 30 can generally vary (see FIGS. 1B and 1C) and is not intended to be limited. The thickness depends on the lateral dimensions and the desired volume of the substantially waterless wetting composition enclosed (described below). In one aspect, the water dispersible pouch 30 has a thickness in a range from about ⅛ inch to about ¾ inch. In another aspect, the water dispersible pouch 30 has a thickness in a range from about 3/16 inch to about 11/16 inch. Yet, in another aspect, the water dispersible pouch 30 has a thickness in a range from about ¼ inch to about ⅝ inch. Still yet, in another aspect, the water dispersible pouch 30 has a thickness in a range from about ¼ inch to about 9/16 inch.

The water dispersible pouch 30 is formed from a film formed from one or more polymers. The polymeric film is substantially water soluble. The polymeric film has a thickness that may generally vary. In some aspects, the film (the body portion of the film) has a thickness in a range from about 15 to about 75 micrometers (microns). In other aspects, the film (the body portion of the film) has a thickness in a range from about 15 to about 60 microns. In one aspect, the film (the body portion of the film) has a thickness in a range from about 20 to about 50 microns. Still yet, in another aspect, the film (the body portion of the film) has a thickness about or in any range from about 15, 20, 25, 30, 35, 40, 45, 50, 55, 60, 65, 70, and 75 microns.

The film includes one or more water soluble polymers. Polyvinyl alcohol is an exemplary suitable water soluble polymer. Other suitable water soluble polymers include methyl cellulose, polyacrylic acid, copolymers of polyacrylic acid with other monomers, or any combination thereof. Alternatively, films formed from blends of polyvinyl alcohol with starches can be used.

When polyvinyl alcohol is used in the film, the polyvinyl alcohol can be partially hydrolyzed. In one aspect, the polyvinyl alcohol has a degree of hydrolysis of about 50 to 99%. In some aspects, the degree of hydrolysis is in a range from about 75 to about 96%. In one aspect, the polyvinyl alcohol has a degree of hydrolysis in a range from about 80 to about 95%. In other aspects, the polyvinyl alcohol has a degree of hydrolysis about or in any range from about 50, 55, 60, 65, 70, 75, 80, 85, 90, 95, and 99%.

The polyvinyl alcohol can be a polyvinyl alcohol copolymer. The polyvinyl alcohol can be modified with comonomers, for example, sulfonic acid, carboxylic acid, and/or vinyl amine functional comonomers. The polyvinyl alcohol copolymers may have, for example, a functional comonomer content of from about 2 mole % to about 15 mole %. In other aspects, the polyvinyl alcohol copolymer can have a functional comonomer content about or in any range from about 2, 3, 4, 5, 6, 7, 8, 9, 10, 11, 12, 13, 14, and 15 mole %. The polyvinyl alcohol copolymer can also be partially hydrolyzed, as described above.

The film of the water dispersible pouch 30 encloses a substantially waterless wetting composition that can be used to wet (moisten) a tissue product, wet wipe, or other substrate. The wetting composition can include one or more emollients, humectants, lubricants, oils, medicinal agents, fragrances, and/or other additives.

Non-limiting examples of suitable emollients include long chain saturated fatty acids, such as palmitic acid, gadoleic acid, hyaluronic acid, lactic acid, lauric acid, linoleic acid, myristic acid, oleic acid, palmitic acid, palmitoleic acid, sapienic acid, stearic acid, and essential fatty acids; long chain saturated fatty alcohols, such as alcohols derived from the foregoing acids, cholesterol, sorbitol, vitamin E (tocopherol), esters of these fatty alcohols and fatty acids, triglycerides, wax esters, sterol esters, cholesterol, cholesterol esters, waxes including beeswax, candelilla, carnauba, polyethylene, and paraffin; lanolin (wool grease); propylene glycol; oils, such as almond oil, avocado oil, castor oil, canola oil, coconut oil, corn oil, cottonseed oil, eucalyptus oil, jojoba oil, lavender oil, olive oil, wheat germ oil, palm oil, peanut oil, safflower oil, sesame oil, shea butter, sunflower oil, squalene, phytosqualene, or glycerin; silicones, such as cyclomethicone, cyclopentasiloxane, dimethicone, dimethylpolysiloxane, and dimethylpolysiloxane; and combinations thereof.

Non-limiting examples of humectants that can be used in the substantially waterless wetting composition include glycerol, hydrolyzed silk, ammonium lactate, hydroxypropyltrimonium hydrolyzed silk, hydroxypropyl chitosan, hydroxypropyltrimonium hydrolyzed wheat protein, lactamidopropyltrimonium chloride, ethyl esters of hydrolyzed silk, and combinations thereof.

Other examples of suitable oils include oils of vegetable origin, oils of animal origin, synthetic oil, semi-synthetic oils, or any combination thereof. The oil can be any cosmetically or pharmaceutically acceptable oil, for example any oil used in cosmetic or pharmaceutical compositions. Oils are hydrophobic chemical substances and can be natural, for example derived from vegetal and animal sources, synthetic, or semi-synthetic.

Non-limiting examples of other suitable oils include castor oil, olive oil, corn oil, carnation oil, soy bean oil, tubaki oil, cottonseed oil, sesame oil, avocado oil, jojoba oil, safflower oil, apricot oil, evening primrose oil, rose hip oil, grapeseed oil, coconut oil, carrot seed oil, eucalyptus oil, chamomile oil, neroli oil, tea tree oil, ylang ylang oil, spearmint oil, lavender oil, peppermint oil, sandalwood oil, squalane, mink oil, turtle oil, emu oil, cod liver oil, orange roughy oil, mink oil, sweet almond oil, polybutene, isopropyl myristate, isocetyl myristate, cetylisooctansate, isostearic acid, lauric acid, oleic acid, polyethylene glycol, polyethylene glycol 400, polyethylene glycol 860 monooleate, propylene glycol, glycerol, methylene glycol, polypropylene glycol, guerbet ester, isostearyl alcohol, oleyl alcohol, cetyl alcohol, cetostearyl alcohol, stearyl alcohol, octamethylcyclotetrasiloxane, mineral oil, spindle oil, tamanu oil, or any combination thereof.

The volume of the substantially waterless wetting composition included in the water dispersible pouch 30 depends on the dimensions of the water dispersible pouch 30 and the viscosity of the substantially waterless wetting composition. In some aspects, the water dispersible pouch 30 can include about 2 to about 25 milliliters (mL) of the substantially waterless wetting composition. In other aspects, the water dispersible pouch 30 can include about 3 to about 5 mL of the substantially waterless wetting composition. Yet, in another aspect, the water dispersible pouch 30 includes the substantially waterless wetting composition in an amount about or in any range from about 2, 3, 4, 5, 6, 7, 8, 9, 10, 11, 12, 13, 14, 15, 16, 17, 18, 19, 20, 21, 22, 23, 24, and 25 mL.

The water dispersible pouch 30 can be made by methods known in the art. In one aspect, a method of making a water dispersible pouch 30 includes shaping a sheet of film to form a body portion that encloses a cavity including a substantially waterless wetting composition, the film having a region of weakness that is less than a thickness of body portion; wherein the water dispersible pouch 30 has a rupture strength at the region of weakness of less than 10 pounds per square inch (psi).

Generally, to make the water dispersible pouch 30, a sheet of the film can be molded into the desired shape and then filled with the substantially waterless wetting composition. A sheet of film can be shaped to form the body portion of the film by placing the sheet into a mold, disposing the substantially waterless composition into the sheet within the mold, and sealing the sheet to form the body portion that encloses the cavity. One or more molds may be used to form a single pouch. For example, a portion of a single sheet can be placed in one mold (for example, a hemispherical mold) and the substantially waterless wetting composition can then be disposed in the sheet arranged within the mold. Then the sheet can be folded onto itself (over the mold) to enclose the substantially waterless wetting composition within the film. Alternatively, another sheet of film can be disposed on the sheet within the mold to seal the substantially waterless wetting composition within the pouch.

In another example, two sheets of film and two molds (for example, hemispherical molds) can be used. Each sheet of the film can be arranged within a mold, and then the substantially waterless wetting composition can be disposed within the sheet arranged within one of the molds. The mold and sheet without the substantially waterless wetting composition can then be disposed on the mold with the substantially waterless wetting composition to form the pouch.

Yet, in another example, shaping a sheet of film to form a body portion that encloses a cavity including a substantially waterless wetting composition includes rolling the sheet of film into the shape of a tube, sealing the sheet along two edges (i.e., the lateral and bottom edge), disposing the substantially waterless wetting composition within the rolled sheet, and then sealing the top edge of the film to form the pouch.

Multiple individual pouches can be cut from a large sheet before or after shaping/molding. When a region of weakness (such as a score line) is used to facilitate rupturing the pouch, the region of weakness can be formed in the film before shaping/forming into the pouch shape. The region of weakness may be formed by any any structure that creates a region capable of being broken or torn more easily than the surrounding material. Some other non-limiting examples include incorporating blister reservoirs with weaker material properties into the structure, creating a closure wall that has a breakable boundary, and creating a pouch that has a frangible piercing point (an area of weakness or thinner material that is more easily pierced by a sharp edge).

The edges of the film can be sealed by any suitable method. For example, heat can be applied to the edges of the film to form a heat seal. In another example, the edges of the film may be sealed by applying an adhesive to form adhesive seals. Yet, in another example, the edges of the film may be sewn to form a sewn seal. Any conventional method utilized for sealing the specific polymer(s) including the film can be employed.

Figure 2:
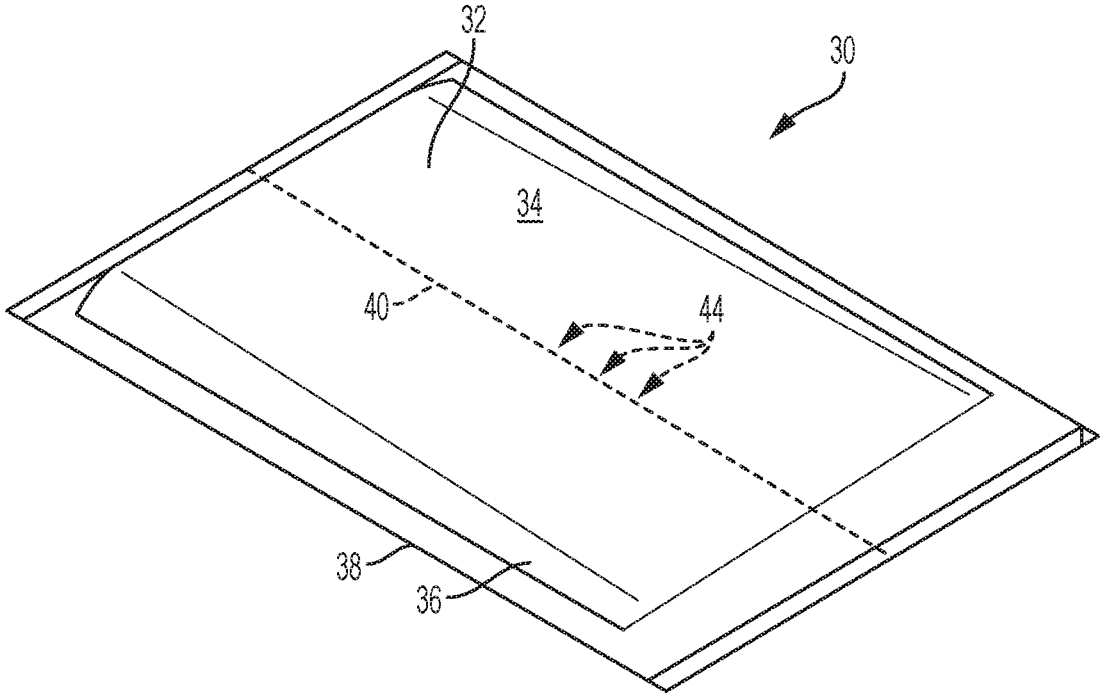
FIG. 2 is a top view of a water dispersible pouch.

FIG. 2 is a top view of a water dispersible pouch 30 according to an aspect of the present invention. The substantially waterless wetting composition is arranged in the central pouch area 32, within the tapering sidewalls 36 and skirt 38. As shown, the scores 44 of score line 40 (region of weakness) proceed medially along a central axis from one end to another end and over the generally planar region 34. Although the score line 40 is shown extending along the long axis of the water dispersible pouch 30, the score line 40 may extend along the short axis (not shown) of the water dispersible pouch 30 in other aspects.

Figure 3:
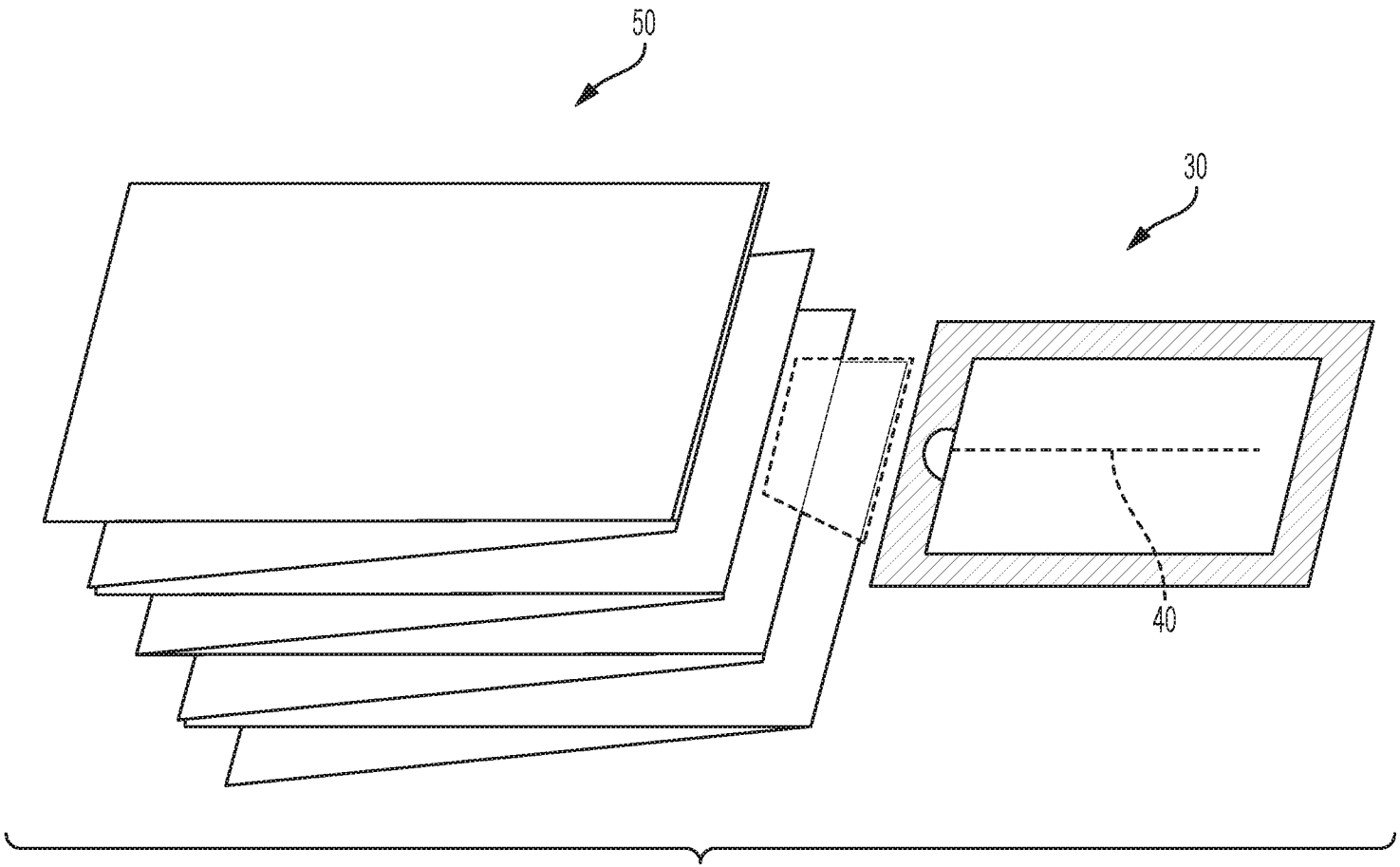
FIG. 3 is a stack of tissues and a water dispersible pouch, illustrating insertion of the water dispersible pouch into the stack of tissues.

FIG. 3 illustrates a stack of tissues 50 and a water dispersible pouch 30. In this illustration, the water dispersible pouch 30 is inserted into the stack of tissues 50. The stack of tissues 50 can include individual tissue sheets that are perforated or non-perforated. Although the stack of tissues 50 is shown as including more than two individual sheets, the water dispersible pouch 30 may be inserted between only two sheets of tissue, or within a first tissue layer and a second tissue layer.

In other aspects, the water dispersible pouch 30 can be inserted between two sheets of a non-woven substrate, two sheets of another cellulosic fiber containing substrate, or other paper-like substrates. Although insertion into a stack or between two sheets prevents the user's hands from being soiled, the pouch can be used on a single substrate if desired. For example, the water dispersible pouch 30 may be arranged on a single tissue (or other substrate mentioned above), and then the user can apply manual pressure to rupture the pouch onto the tissue or other substrate.

For example, to use the water dispersible pouch 30 to moisten the stack of tissues 50, a user can insert the water dispersible pouch into the stack of tissues 50 and apply pressure to the stack of tissues 50. The water dispersible pouch 30 will rupture along the region of weakness (scores of the score line 40) to release the substantially waterless wetting composition onto the tissues within the stack of tissues 50.

After releasing the contents of the water dispersible pouch 30, the pouch is substantially flattened within the stack of tissues 50 (or onto the substrate). Then, the user can use the tissues (i.e., wipe or clean) with the water dispersible pouch 30 within the stack and discard in the toilet or receptacle. Because the pouch is water dispersible, it can be safely discarded with the tissues (i.e., bath tissues) in the toilet.

As mentioned above, the region of weakness is used to facilitate opening (rupture) of the water dispersible pouch 30. The water dispersible pouch 30 can include one or more regions of weakness. The region of weakness can be, for example, in the form of a score line 40. The film that encloses the substantially waterless wetting composition has a body portion and a region of weakness. The region of weakness can include one or more regions in which the thickness of the film is less than the body portion (described above). The body portion and the region of weakness have different thicknesses. The thickness of the body portion is defined above as the total thickness of the film. Because the region of weakness is thinner than the body portion, the pouch will rupture at the region of weakness to release the contents onto the tissue or substrate.

When a score line 40 is used, the depth of the scores and the score pattern generally vary. Although the score line 40 shown in FIGS. 1A, 2, and 3 are straight lines, the score line 40 can take the form of a curved line, a wavy (sinusoidal) line, or other suitable pattern. The score line 40 can be formed from a series of weak (thinner) and strong (thicker) areas. Alternatively, the entire score line 40 can be a weakened area within the film. The score line 40 can extend from one end of the pouch to the other, or score line 40 may only partially extend across the pouch. Optionally, visual indicia (not shown) can be placed on opposing sides of the score line 40 to show the user where to apply pressure to rupture the water dispersible pouch 30.

When a score line 40 is used, the depth of scores of the score line 40 depends on the thickness of the external film. In some aspects, the scores (regions of weakness) extend from the surface of the film to a depth of about 25% to about 80% of the thickness of film (or the thickness of the body portion). In one aspect, the scores (regions of weakness) extend from the surface of the film to a depth of about 30% to about 75% of the thickness of the film (or the thickness of the body portion). In another aspect, the scores (regions of weakness) extend from the surface of the film to a depth of about 35% to about 65% of the thickness of film. Yet, in another aspect, the scores (regions of weakness) extend from the surface of the film to a depth about or in any range from about 25, 30, 35, 40, 45, 50, 55, 60, 65, 70, 75, and 80% of the thickness of the film (or the thickness of the body portion).

The thickness of the film and the depth region of weakness is controlled such that water dispersible pouch 30 can be opened by applying a manual pressure of less than about 10 pounds per square inch (psi). In other words, the pouch has a rupture strength at the region of weakness of less than 10 pounds psi. In one aspect, the water dispersible pouch 30 has a rupture strength of less than 10 psi, or less than 5 psi, or less than 2 psi. In other aspects, the water dispersible pouch has a rupture strength about or in any range from about 10, 9, 8, 7, 6, 5, 4, 3, 2, 1, 0.5, and 0.25 psi.

In one aspect, a user can rupture the water dispersible pouch 30 to release the substantially waterless wetting composition onto the tissue or substrate using his/her own hand(s). In contrast to pouches sold for other applications, for example, dishwashing detergent and laundry detergent that are difficult to rupture with manually applied pressure (i.e., pressure applied with a user's hands), the water dispersible pouches 30 disclosed herein can be ruptured to release the contents without additional tools or machines. However, the water dispersible pouch 30 may be ruptured using other methods.

The region of weakness (i.e., score patterns) in film may have shallows sections of a first depth interspersed with deep scores of a second depth. The score patterns will be chosen to yield a chosen rupture pressure as discussed above such that the water dispersible pouch 30 will withstand pressures associated with transport in a purse or pocket, while remaining rupturable with manually applied pressure. For packs which are carried without a protective shell, the regions of weakness that are somewhat more rugged to avoid inadvertent or undesired rupture.

To prevent undesired rupturing of the film, the pouches can be packaged individually or severally, in a sealable protective impermeable case. The protective case can prevent the substantially waterless wetting composition from being unintentionally released inside the user's handbag or during other means of storage and/or transportation. Polyethylene, for example, and many other known polymers are suitable for use as an overwrap for this purpose. The protective case may be produced from any sufficiently rigid material but moldable polymers, for example, polypropylene.

Figure 4:
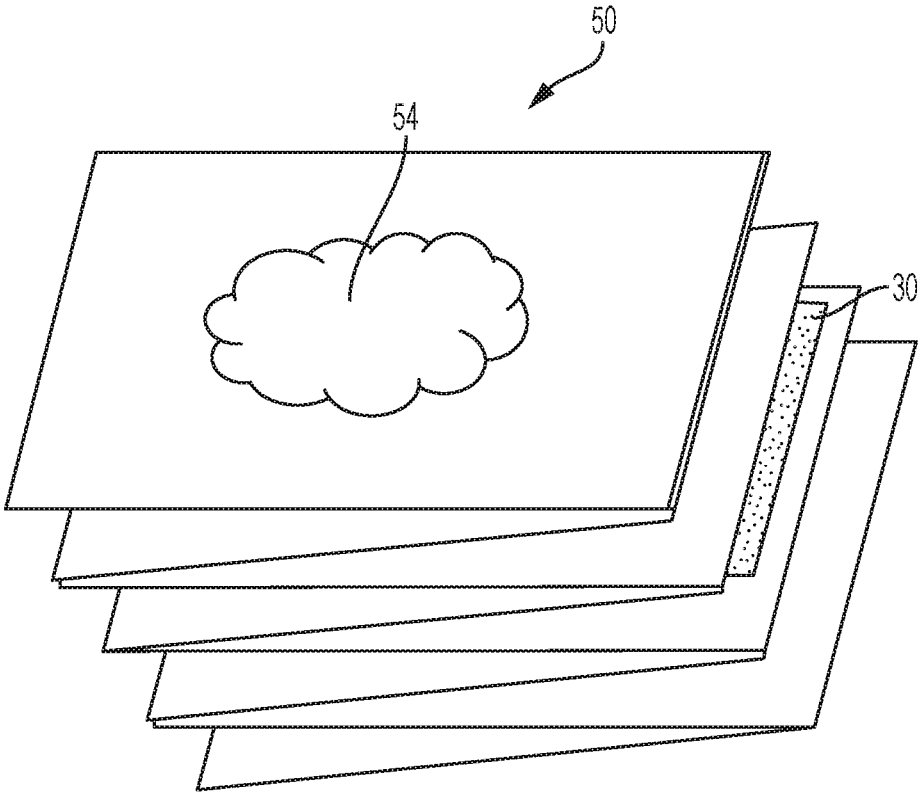
FIG. 4 illustrates the stack of tissues and water dispersible pouch after inserting the water dispersible pouch into the stack of tissues.

FIG. 4 illustrates the stack of tissues 50 and water dispersible pouch 30 after inserting the water dispersible pouch 30 into the stack of tissues 50. After a user applies manual pressure to the stack of tissues 50, the water dispersible pouch 30 releases the substantially waterless wetting composition to moisten the tissues by forming a wet area 54. The user can then use the wetted/moisturized tissue as desired. After use, the water dispersible pouch 30 can be discarded with the tissue down the toilet. Because the pouch is water dispersible, it can be easily discarded within the tissues.

In addition to using a score line 40 as the region of weakness to release contents from the water dispersible pouch 30 as shown in FIGS. 1A-4, the water dispersible pouch 30 may have other designs to release the substantially waterless wetting composition. Other non-limiting exemplary designs are shown in FIGS. 5A-6B.

Figure 5A:
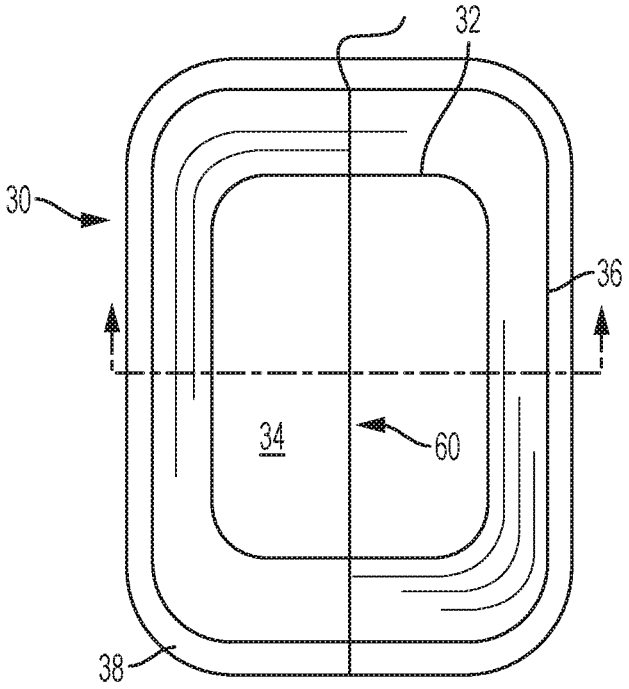
FIGS. 5A and 5B are a top view and side view, respectively, of a water dispersible pouch with a tear string embedded on a surface of the pouch.
Figure 5B:
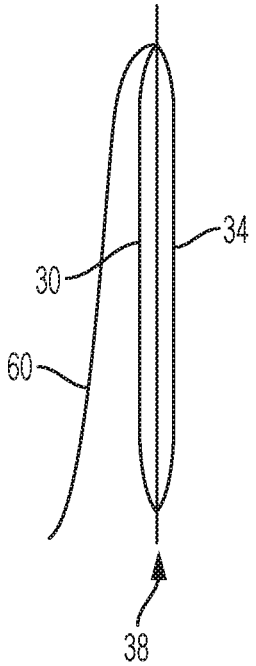

FIGS. 5A and 5B are a top view and side view, respectively, of a water dispersible pouch 30 with a tear string 60 embedded on a surface. The central pouch area 32 includes a generally planar region 34. The generally planar region 34 tapers down through tapering side walls 36 toward the skirt 38 surrounding central pouch area 32. The tear string 60 is embedded in the external film, leaving a thin margin of film underneath tear string 60. When the tear string 60 is pulled, the water dispersible pouch 30 almost opened, but not completely, and the region of weakness is exposed. In this aspect, the region of weakness is arranged beneath the tear string 60. Then only a slight force is necessary to rupture the thin margin of film underneath tear string 60 at the region of weakness. The water dispersible pouch 30 has considerable strength during transportation but is easily opened by the user when needed by exerting simple manual pressure using only one's hands on either side of the line of tear string 60 after it has been pulled. The tear string 60 can have a tail of considerable extra length so that water dispersible pouch 30 can be easily pre-ruptured inside or outside of stack of tissue (see FIG. 4).

Figure 6A:
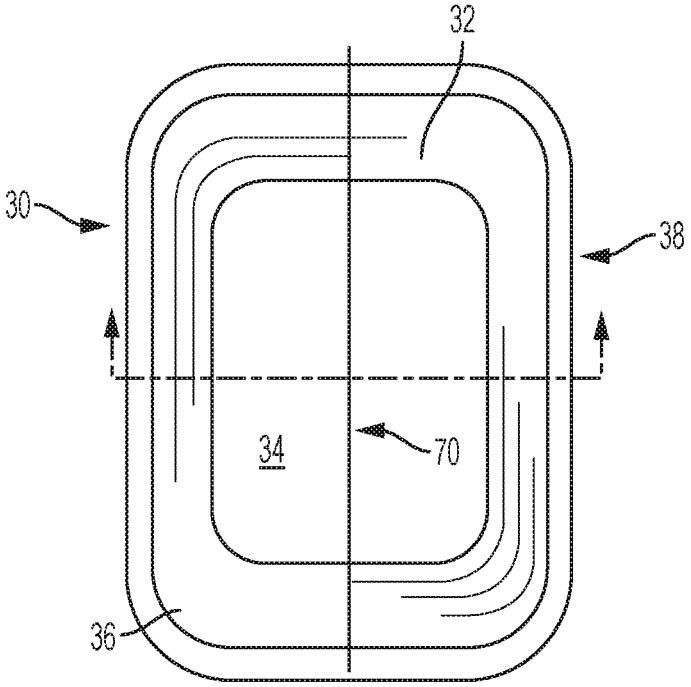
FIGS. 6A and 6B are a top view and side view, respectively, of a water dispersible pouch with a tear tape embedded on a surface of the pouch.
Figure 6B:
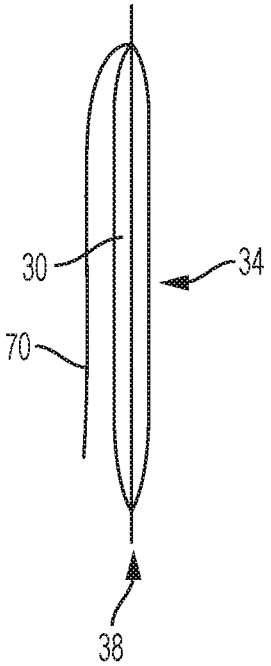

FIGS. 6A and 6B are a top view and side view, respectively, of a water dispersible pouch 30 with a tear strip 70 embedded on a surface of the water dispersible pouch 30. The central pouch area 32 includes a generally planar region 34 as viewed from the side. The planar shape should not be considered as limiting. Alternative shapes in region 34, such as oval, round, ribbed, and the like can be employed. The generally planar region 34 tapers down through tapering side walls 36 towards the skirt 38 surrounding central pouch area 32. The tear strip 70 is embedded in film of water dispersible pouch 30, leaving a thin margin of film underneath tear strip 70 (region of weakness). When the tear strip 70 is pulled, water dispersible pouch 30 is almost opened, but not completely. Then only a slight force is needed to rupture the thin margin of film (region of weakness) underneath tear strip 70. The water dispersible pouch 30 has considerable strength during transportation but is easily opened by the user when needed by exerting simple manual pressure on either side of the line of tear strip 70 after it has been pulled.

With respect to the above description, it is to be realized that the optimum proportional relationships for the parts of the invention, to include variations in components, concentration, shape, form, function, and manner of manufacture, and use, are deemed readily apparent and obvious to one skilled in the art, and all equivalent relationships to those illustrated in the specification are intended to be encompassed by the present invention.

Therefore, the foregoing is considered as illustrative only of the principles of the invention. Further, various modifications may be made of the invention without departing from the scope thereof, and it is desired, therefore, that only such limitations shall be placed thereon as are imposed by the prior art and which are set forth in the appended claims.

What is claimed is:

1. A water dispersible pouch, the water dispersible pouch comprising:

a film that encloses a cavity, the film having a body portion and a region of weakness, the region of weakness having a thickness that is less than a thickness of the body portion and a rupture strength of less than 10 pounds per square inch (psi); and a substantially waterless wetting composition disposed within the cavity, the substantially waterless wetting composition consisting of less than 15 weight % (wt. %) water, and an emollient, a lubricant, a humectant, a medicinal agent, a fragrance, or a combination thereof.

2. The water dispersible pouch of claim 1, wherein the film comprises a water soluble polymer.

3. The water dispersible pouch of claim 1, wherein the film comprises a polyvinyl alcohol.

4. The water dispersible pouch of claim 1, wherein the film comprises a partially hydrolyzed polyvinyl alcohol.

5. The water dispersible pouch of claim 1, wherein the emollient is an oil.

6. The water dispersible pouch of claim 5, wherein the oil is mineral oil.

7. The water dispersible pouch of claim 1, wherein the water dispersible pouch is used for moistening a tissue.

8. The water dispersible pouch of claim 7, wherein the tissue is a bath tissue or a facial tissue.

9. A water dispersible pouch, the water dispersible pouch comprising:

a polyvinyl alcohol film that encloses a cavity, the polyvinyl alcohol film having a body portion and a region of weakness, the region of weakness having a thickness that is less than a thickness of the body portion and a rupture strength of less than 10 pounds per square inch (psi); and a substantially waterless wetting composition consisting of an oil and less than 15 weight % (wt. %) water disposed within the cavity.

10. The water dispersible pouch of claim 9, wherein the rupture strength is less than 5 pounds per square inch (psi).

11. The water dispersible pouch of claim 9, wherein the rupture strength is less than 2 psi.

12. The water dispersible pouch of claim 9, wherein the water dispersible pouch comprises the substantially waterless wetting composition in an amount in a range from about 2 to about 25 milliliters (mL).

13. The water dispersible pouch of claim 9, wherein the polyvinyl alcohol film comprises a polyvinyl alcohol copolymer.

14. The water dispersible pouch of claim 9, wherein the thickness of the region of weakness is about 25 to about 80% of the thickness of the body portion.

15. A method of making a water dispersible pouch, the method comprising:

shaping a sheet of film to form a body portion that encloses a cavity comprising a substantially waterless wetting composition, the film having a region of weakness that is less than a thickness of the body portion and a rupture strength of less than 10 pounds per square inch (psi), and the substantially waterless wetting composition consisting of less than 15 weight % (wt. %) water, and an emollient, a lubricant, a humectant, a medicinal agent, a fragrance, or a combination thereof.

16. The method of claim 15, wherein shaping the sheet of film to form the body portion comprises placing the sheet of film into a mold, disposing the substantially waterless wetting composition into the sheet within the mold, and sealing the sheet to form the body portion that encloses the cavity.

17. The method of claim 16, wherein the sheet is folded onto itself to seal the film to form the body portion.

18. The method of claim 16, wherein another sheet of film is disposed on the sheet of film in the mold to seal the sheet of film and form the body portion.

19. The method of claim 15, further comprising cutting the sheet of film after shaping the sheet of film to form the water dispersible pouch.

20. The method of claim 15, wherein the water dispersible pouch is used for moistening a tissue.

21. The method of claim 20, wherein the tissue is a bath tissue or facial tissue.

22. The method of claim 15, further comprising sealing edges of the film after shaping the sheet of film to form the body portion.

23. The method of claim 15, further comprising forming the region of weakness in the film before shaping the sheet of film.

24. The method of claim 15, wherein the region of weakness is a score line.

* * * * *